US008464544B2

(12) United States Patent
Shin et al.

(10) Patent No.: US 8,464,544 B2
(45) Date of Patent: Jun. 18, 2013

(54) REFRIGERATOR AND CONTROL METHOD THEREOF

(75) Inventors: Young Shik Shin, Seongnam-si (KR); Jeong Han Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1077 days.

(21) Appl. No.: 12/382,865

(22) Filed: Mar. 25, 2009

(65) Prior Publication Data

US 2009/0254220 A1 Oct. 8, 2009

(30) Foreign Application Priority Data

Apr. 7, 2008 (KR) ..... 10-2008-32230

(51) Int. Cl.

| | |
|---|---|
| ***G05D 23/32*** | (2006.01) |
| ***G05D 23/00*** | (2006.01) |
| ***F25D 11/00*** | (2006.01) |
| ***G01M 1/38*** | (2006.01) |

(52) U.S. Cl.
USPC ..... 62/157; 62/440; 700/278; 700/299

(58) Field of Classification Search
USPC ..... 62/157, 440, 441; 700/275, 299, 700/278, 32
See application file for complete search history.

(56) References Cited

U.S. PATENT DOCUMENTS

| | | | | |
|---|---|---|---|---|
| 7,784,298 | B2 * | 8/2010 | Ha et al. | 62/340 |
| 2007/0039334 | A1 * | 2/2007 | Hong | 62/129 |
| 2008/0115511 | A1 * | 5/2008 | Barone et al. | 62/62 |

FOREIGN PATENT DOCUMENTS

| | | | |
|---|---|---|---|
| CN | 101000197 | | 7/2007 |
| JP | 2000166487 | A * | 6/2000 |
| JP | 2000175626 | A * | 6/2000 |
| KR | 10-0756712 | | 8/2007 |
| KR | 10-0756712 | B1 | 8/2007 |
| KR | 100756712 | B1 * | 8/2007 |

OTHER PUBLICATIONS

Chinese Office Action dated Apr. 5, 2012 issued in corresponding Chinese Patent Application No. 200910134018.
Chinese Office Action issued Dec. 14, 2012, in corresponding Chinese Patent Application No. 200910134018.X.

* cited by examiner

*Primary Examiner* — Chen Wen Jiang
(74) *Attorney, Agent, or Firm* — Staas & Halsey LLP

(57) ABSTRACT

A refrigerator capable of supercooling a target object and a control method thereof are provided. The refrigerator includes a temperature sensor which senses a temperature of the target object in the cooling compartment, wherein the temperature sensor is prevented from being in contact with ambient cool air and is installed on a bottom surface on which the target object is placed so as to sense only the temperature of the target object. Further, the control method includes sensing a temperature of the target object at each interval of a specified time Δt, calculating a difference between two temperatures sensed at specified time intervals, and comparing the difference between two temperatures with a predetermined reference value ΔTc to determine the supercooled state of the target object.

15 Claims, 9 Drawing Sheets

(b)

REFRIGERATOR AND CONTROL METHOD THEREOF

CROSS-REFERENCE TO RELATED APPLICATIONS

This application claims the benefit of Korean Patent Application No. 2008-0032230, filed on Apr. 7, 2008 in the Korean Intellectual Property Office, the disclosure of which is incorporated herein by reference.

BACKGROUND

1. Field

The present invention relates to a refrigerator, and, more particularly, to a refrigerator capable of accurately sensing the temperature of, for example, a beverage stored in a supercooling compartment and whether the beverage is in a supercooled state, and a control method thereof.

2. Description of the Related Art

A refrigerator is an apparatus which supplies cool air produced by a refrigerating unit to a storage compartment to maintain freshness of various food products for a long period of time. In a case of appropriately adjusting the temperature of the compartment of the refrigerator, a liquid beverage can be maintained in a supercooled state, and a user can use the supercooled beverage to obtain a beverage which is not completely frozen or not completely melted (hereinafter, referred to as 'slush').

The liquid beverage is generally changed to a solid phase when its temperature decreases below its freezing point under 1 atmospheric pressure. However, in some circumstances, the beverage is not changed into the solid phase and is maintained in a supercooled state. Such a supercooled state in which liquid is not frozen, even below the freezing point, is referred to as a metastable state in thermodynamics. Since the liquid in the metastable state is not stable, the beverage instantaneously undergoes a phase transition to the solid phase when there is ambient disturbance such as impact or vibration. When there is a phase transition, the beverage or food is changed into a frozen state from the supercooled state.

As an example, a refrigerator capable of determining whether the supercooled state is achieved is disclosed in Korean Patent Registration No. 10-756712.

This reference discloses a refrigerator including a temperature sensor which measures the temperature of the supercooling compartment such that the temperature of the supercooling compartment is continuously sensed by the temperature sensor, wherein when the temperature continuously increases for a specific time period or more, or when the temperature of the supercooling compartment is stabilized after the temperature increases by a predetermined value, a control unit determines that the supercooled state is canceled and notifies the outside through a display unit, and a method of determining an end of the supercooled state of the refrigerator.

In the conventional refrigerator disclosed in this reference, since the temperature sensor is disposed at an upper portion of the supercooling compartment while being spaced from the liquid beverage stored in the supercooling compartment, there is a problem that the temperature of the liquid beverage or the like cannot be accurately measured.

Further, the temperature of the supercooling compartment is changed due to opening/closing of an adjuster such as a valve and a damper, which adjusts cool air of the storage compartment to flow into the supercooling compartment, opening/closing of the supercooling compartment, or the like. A method of determining an end of the supercooled state of the conventional refrigerator has a problem of misdetermination in which it is determined that the supercooled state of the supercooled object is canceled when the temperature continuously increases for a specific time period, or also when the temperature is stabilized after the temperature increases by a predetermined value due to temperature variation of the supercooling compartment.

Further, in the method of determining cancellation of the supercooled state of the conventional refrigerator, which is disclosed in the document, only cancellation of the supercooled state can be determined and it is impossible to determine whether supercooling is achieved and fails to be achieved.

SUMMARY

Accordingly, it is an aspect of the present invention to solve the above problems. It is another aspect of the present invention to provide a refrigerator capable of improving accuracy in determination of a supercooled state of a target object by accurately sensing the temperature of only the target object in the supercooling compartment regardless of an operation of an adjuster which controls cool air flowing into the supercooling compartment or opening/closing of the supercooling compartment.

Further, it is another aspect of the present invention to provide a control method of a refrigerator capable of more accurately determining whether supercooling fails to be achieved by using a sharp inclination in a temperature increase and a temperature increment, which are generated in cancellation of the supercooled state in a case of determining whether the object is in a supercooled state. Further, it is another aspect of the present invention to provide a control method of a refrigerator capable of improving reliability and durability of the refrigerator by controlling the refrigerator not to determine whether supercooling fails to be achieved in a section which is not required for the determination, so as to prevent excessive load due to an unnecessary calculation operation.

Further, another aspect of the present invention to provide a control method of a refrigerator capable of determining not only whether supercooling fails to be achieved, but also whether supercooling of a target object is achieved.

Additional aspects and/or advantages of the invention will be set forth in part in the description which follows and, in part, will be apparent from the description, or may be learned by practice of the invention.

The foregoing and/or other aspects of the present invention are achieved by providing a refrigerator which determines a supercooled state of a target object comprising: a cooling compartment, the target object being in the cooling compartment; a temperature sensor which senses a temperature of the target object in the cooling compartment, the target object being between ambient air of the cooling compartment and the temperature sensor.

The temperature sensor is configured as a non-contact temperature sensor and is installed at a position lower than the bottom surface. The bottom surface includes a protruding portion protruded corresponding to a lower recessed portion of a container containing the target object, and the temperature sensor is installed on the protruding portion of the bottom surface.

The foregoing and/or other aspects of the present invention may also achieved by providing a control method of a refrigerator to determine a supercooled state of a target object in a cooling compartment, the method comprising: sensing a temperature of the target object at each interval of a specified time Δt; calculating a difference between two of the sensed temperatures; and comparing the difference between the two temperatures with a predetermined reference value ΔTc to determine the supercooled state of the target object.

If the difference between two temperatures is smaller than the predetermined reference value, it is determined that the progress of the supercooling is normal. If the difference between two temperatures is equal to or larger than the predetermined reference value, it is determined that supercooling has not been achieved. The method further includes stopping cooling of the target object if it is determined that supercooling has failed.

The calculating a difference between two sensed temperatures is performed only in a case where the sensed temperatures are lower than a freezing point of the target object.

The method further includes determining whether supercooling of the target object is achieved by determining whether the temperature of the target object is equal to or lower than a target supercooling temperature if it is determined that supercooling is normally in progress. Further, the method further includes displaying determination results of the supercooled state.

The reference value is larger than a temperature variation in the supercooling compartment generated according to whether cool air is supplied to the cooling compartment or an opening/closing operation of the cooling compartment and is smaller than a temperature variation which is rapidly increased when supercooling fails to be achieved. Further, the reference value varies according to a type of the target object. A type of the target object is manually inputted by a user or is automatically inputted and identified by a barcode or RFID. The specified time is designed using the predetermined reference value and a temperature inclination rapidly increased when supercooling fails to be achieved.

The foregoing and/or other aspects of the present invention are achieved by providing a control method of a refrigerator to determine a supercooled state of a target object in a cooling compartment, the method comprising: sensing a temperature of the target object on a real-time basis within a specified time period; determining whether the temperature continuously increases within the specified time period; and if the temperature continuously increases, integrating a temperature increment within the specified time period and comparing the integrated temperature increment with a predetermined reference value ΔTc to determine the supercooled state of the target object.

If the integrated temperature increment is smaller than the predetermined reference value, it is determined that supercooling progresses normally, and if the integrated temperature increment is equal to or larger than the predetermined reference value, it is determined that supercooling has not been achieved.

The method further includes determining whether supercooling of the target object is achieved by determining whether the temperature of the target object sensed on a real-time basis is equal to or lower than a target supercooling temperature if it is determined that supercooling is progressing normally. The method further includes stopping cooling of the target object if it is determined that supercooling fails to be achieved.

The determining whether the temperature continuously increases is performed only in a case where the temperature sensed on a real-time basis is lower than a freezing point of the target object.

The foregoing and/or other aspects of the present invention are achieved by providing a refrigerator which determines a supercooled state of a target object, comprising: a cooling compartment, the target object being in the cooling compartment; a temperature sensor which senses a temperature of the target object in the cooling compartment; and a controller which calculates a difference between two temperatures of the sensed temperatures at specified time intervals and compares the difference between the two temperatures with a predetermined reference value ΔTc to determine the supercooled state of the target object.

The refrigerator further includes an input unit into which a type of the target object is inputted or a reader which automatically reads a type of the target object; and a memory which stores a reference value according to a type of the target object, wherein the controller varies the reference value according to a type of the target object.

The refrigerator further includes a display unit which displays determination results of the supercooled state.

As described above, in the installation structure of the present temperature sensor since the temperature sensor is in contact or no contact with only the liquid beverage container without being in direct contact with cool air, it is possible to accurately measure the actual temperature of the liquid beverage regardless of temperature variation of the supercooling compartment according to the opening/closing of the flaps or the opening/closing of the supercooling compartment.

Further, the control method of the refrigerator according to the first embodiment of the present invention provides an algorithm in which the predetermined reference value ΔTc and an interval of the specified time Δt are determined based on a rapid temperature increase change (inclination or the like) in failure of supercooling of the liquid beverage, a temperature difference value is calculated at each specified time interval, and it is determined whether supercooling fails to be achieved based thereon. Accordingly, it is possible to prevent erroneous determination in which an increase in the temperature due to other causes (e.g., opening of the supercooling compartment, failure of a power supply or the like) except failure of supercooling of the liquid beverage is determined to be generated by failure of supercooling.

Further, since it is determined whether supercooling fails to be achieved below the freezing point of the liquid beverage, it is possible to prevent an unnecessary calculation load above the freezing point, which is not required to determine whether supercooling fails to be achieved.

Further, in the control method of the refrigerator according to the second embodiment of the present invention, it is also determined whether the liquid beverage has a target supercooling temperature in addition to whether supercooling is normally in progress. Then, the user is informed whether the user can use the liquid beverage.

BRIEF DESCRIPTION OF THE DRAWINGS

These and/or other aspects and advantages will become apparent and more readily appreciated from the following description of the embodiments, taken in conjunction with the accompanying drawings, of which.

DETAILED DESCRIPTION OF EMBODIMENTS

Figure 1:
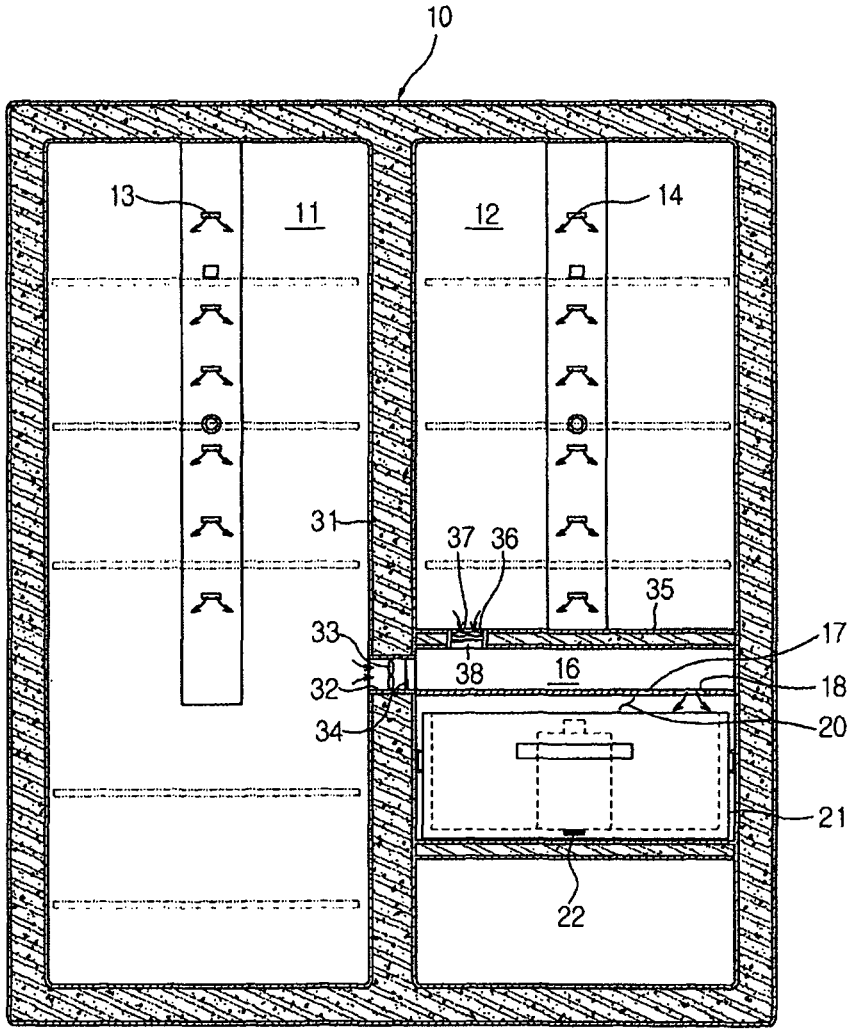
FIG. 1 illustrates a cross-sectional view showing a schematic configuration of the refrigerator according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Figure 2:
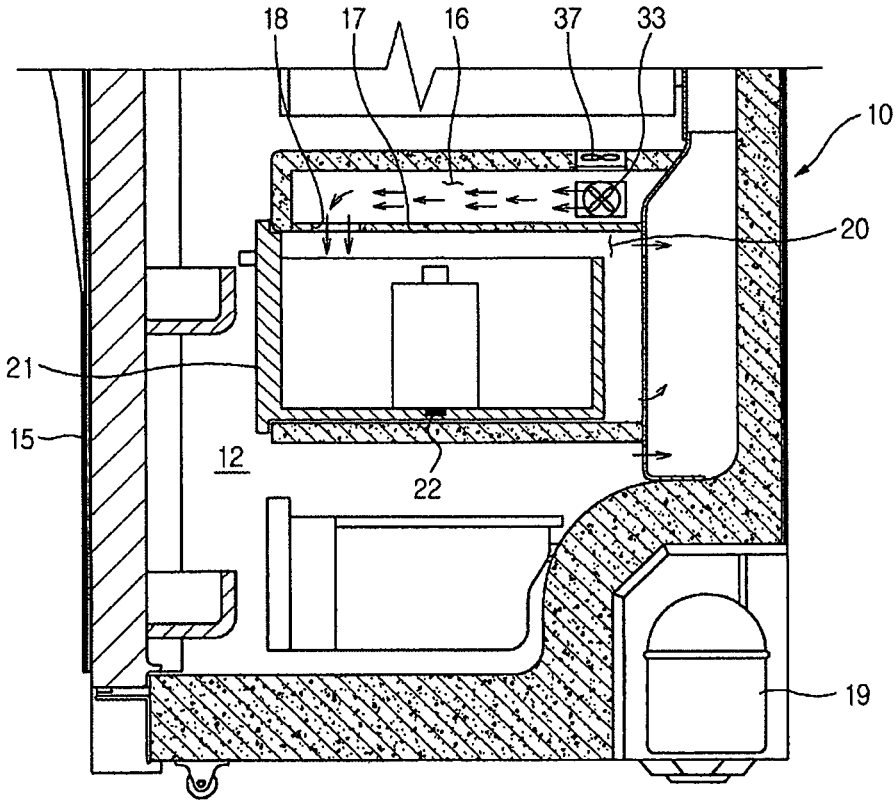
FIG. 2 illustrates a side cross-sectional view showing essential parts of the refrigerator according to an embodiment of the present invention.

FIG. 1 illustrates a cross-sectional view showing a schematic configuration of the refrigerator according to the embodiment of the present invention. FIG. 2 illustrates a side cross-sectional view showing essential parts of the refrigerator according to the present invention.

As shown in FIGS. 1 and 2, the refrigerator according to the embodiment of the present invention includes a main body 10 having a freezing compartment 11, a cooling compartment 12 and a supercooling compartment 20, a temperature sensor 22 which senses the temperature of beverages accommodated in the supercooling compartment 20, and a controller (see FIG. 4) which controls the operation of the temperature sensor and other electric devices.

The refrigerator according to the embodiment of the present invention has a refrigeration cycle to refrigerate the compartments in the same way as a general refrigerator, the refrigeration cycle including a compressor 19 which compresses a coolant, a condenser (not shown) which condenses a coolant, an expander (not shown) which decompresses a coolant, an evaporator (not shown) which evaporates a coolant, and the like.

The inside of the main body 10 is divided into the freezing compartment 11 and the cooling compartment 12 by a middle partition wall 31. Doors 15 are installed on the main body 10 to open and close the freezing compartment 11 and the cooling compartment 12. The freezing compartment 11 and the cooling compartment 12 are supplied with cool air heat-exchanged with the evaporator (not shown) through a plurality of cool air inlets 13 and 14 connected to the inside of the main body 10. The cool air supplied to the freezing compartment 11 is controlled to be maintained at a freezing temperature (e.g., −18° C. to −21° C.) capable of sufficiently freezing food. The cooling compartment 12 is controlled to be maintained at a cooling temperature (e.g., 3° C. to 5° C.) capable of cooling food.

The supercooling compartment 20 is installed at a lower portion of the cooling compartment 12. The supercooling compartment 20 is separated from the cooling compartment 12 by a partition wall 35. Further, a mixing room 16 is disposed at an upper portion of the supercooling compartment 20 to mix cool air of the freezing compartment 11 and the cooling compartment 12. The mixing room 16 and the supercooling compartment 20 are disposed adjacent to each other and are separated from each other by a partition plate 17.

The mixing room 16 has a first suction port 32 and a second suction port 36 to suck cool air from the freezing compartment 11 and the cooling compartment 12, respectively. In a case where the mixing room 16 and the supercooling compartment 20 are disposed in the cooling compartment 12, the first suction port 32 passes through the middle partition wall 31 to communicate with the freezing compartment 11, and the second suction port 36 passes through one side of the partition wall 35 which separates the mixing room 16 and the cooling compartment 12 from each other to communicate with the cooling compartment 12. At the first suction port 32 and the second suction port 36, there are installed blower fans 33 and 37, which provide power required to suck cool air of the freezing compartment or cool air of the cooling compartment, and flaps 34 and 38, which open and close the first suction port 32 or the second suction port 36 according to the operation of the blower fans 33 and 37. Further, the mixing room 16 includes a cool air supply port 18 formed on the partition plate 17 such that cool air mixed in the mixing room 16 is directly supplied to the supercooling compartment 20.

Although cool air in the freezing compartment and cool air in the cooling compartment are mixed and supplied to the supercooling compartment 20 to adjust the temperature of the supplied cool air in this embodiment, cool air may be supplied by any other method capable of realizing a temperature set in the supercooling compartment 20.

A tray 21 is installed in the supercooling compartment 20 to move forward and backward. A liquid beverage is stored in the tray 21. Although the supercooling compartment is configured as a tray in this embodiment, the present invention is not limited thereto, and the supercooling compartment may be configured as a storage compartment without an additional tray.

The supercooling compartment 20 includes the temperature sensor 22 installed to measure the temperature of a target object in the supercooling compartment 20. If the tray 21 is included, the temperature sensor 22 is installed on the bottom surface of the tray. If the tray 21 is not included, the temperature sensor 22 is installed on the bottom surface of the supercooling compartment. The controller compares the temperature measured by the temperature sensor 22 with the set temperature of the supercooling compartment 20. As a comparison result, the controller controls the operation of the blower fans 33 and 37 to adjust the suction amount of cool air of the freezing compartment and the suction amount of cool air of the cooling compartment.

In this case, the temperature sensor 22 is installed in the supercooling compartment 20. The temperature sensor 22 is disposed at a position adjacent to the liquid beverage in no contact with cool air of the supercooling compartment, to accurately measure the temperature of the liquid beverage. For example, the temperature sensor 22 is disposed on the lower surface of the tray 21 on which the liquid beverage is placed. In this configuration, it is possible to measure the temperature of the liquid beverage while direct contact between the cool air in the supercooling compartment and the temperature sensor 22 is prevented by a liquid beverage container. According to this configuration, since the temperature sensor 22 is in direct contact with the bottom surface of the liquid beverage, it is possible to accurately measure the temperature of the liquid beverage. Further, since there is no contact with the cool air of the supercooling compartment, it is not related to temperature variation caused by cool air being supplied to the supercooling compartment and whether the supercooling compartment is opened or closed.

Figure 3A:
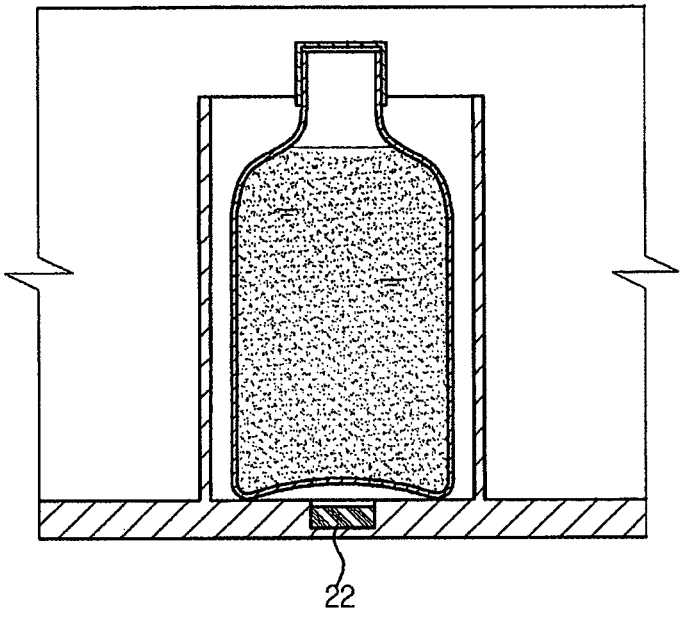
FIGS. 3A and 3B illustrate a modified example of an installation structure of a temperature sensor of the refrigerator according to an embodiment of the present invention.

In a case where the bottom surface of the liquid beverage container is flat, a contact temperature sensor which senses the temperature by direct contact may be used. However, generally, the bottom surface of the liquid beverage container may have a recess shape. Accordingly, as a modified example of an installation structure of the temperature sensor, as shown in FIG. 3A, a non-contact temperature sensor is provided to sense the temperature of the liquid beverage when the bottom surface of the liquid beverage container has a recess shape. Further, the non-contact temperature sensor is disposed at a position slightly lower than the lower surface of the tray. Accordingly, it is also possible to sense the temperature of the liquid beverage whose container has a flat bottom surface.

Figure 3B:
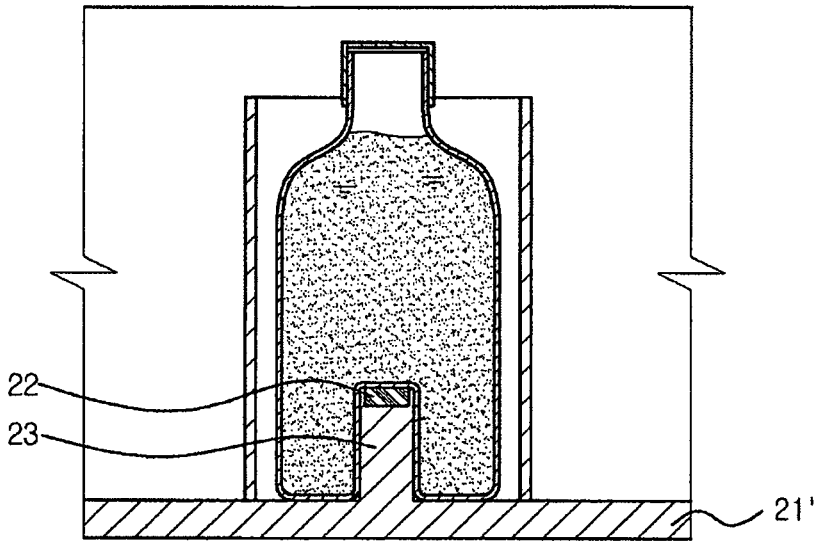

Further, in a case of providing a separate container for supercooled beverages, as shown in FIG. 3B, a central portion of the bottom surface of the single-purpose container is recessedly formed and a protruding portion 23 is formed to protrude from the lower surface of a tray 21' corresponding to the recessed portion. The temperature sensor 22 is installed at an upper end of the protruding portion 23. In this case, since the temperature sensor is positioned inside the liquid beverage, it is possible to more accurately sense the temperature of the liquid beverage as compared to a case where the temperature sensor is positioned on the bottom surface.

As described above, in a case where the temperature sensor is disposed at the cool air supply port or any one side of the side surface or the upper surface of the supercooling compartment as in the related art, since the temperature sensor is spaced from the target object, although the actual temperature of the liquid beverage is not changed, the temperature sensor senses the temperature of the supercooling compartment which is changed according to opening/closing of the flaps caused by the operation of the blower fans and opening/closing of the supercooling compartment, thereby resulting in inaccurate measurement of the temperature of the liquid beverage. Accordingly, in a case where the temperature of the supercooling compartment does not increase by loss of the supercooled state of the liquid beverage, that is, when the temperature of the supercooling compartment continuously increases within a specific range due to frequent opening/closing of the user or other causes, although there is no loss of the supercooled state, it may be determined that the supercooled state is lost, thereby causing misdetermination.

On the other hand, in the installation structure of the temperature sensor 22 according to the embodiments present invention, since the temperature sensor 22 is in contact or no contact with only the liquid beverage container without being in direct contact with cool air, it is possible to accurately measure the actual temperature of the liquid beverage regardless of temperature variation of the supercooling compartment according to the opening/closing of the flaps or the opening/closing of the supercooling compartment. Thus, the embodiments of the present invention provide a control method to be described later, in which failure/achievement of supercooling is determined based on the actual temperature of the liquid beverage, thereby reducing misdetermination regarding the failure/achievement of supercooling.

Figure 4:
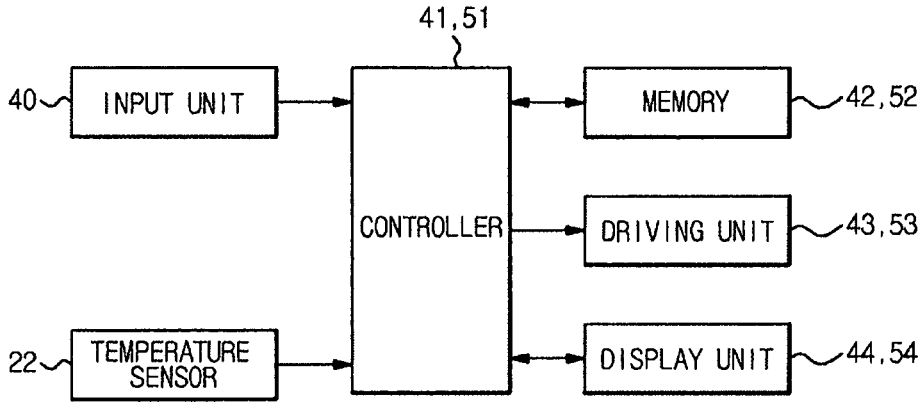
FIG. 4 is a control block diagram of a refrigerator according to first and second embodiments of the present invention.

FIG. 4 is a control block diagram of a refrigerator according to a first embodiment of the present invention, which includes an input unit 40 into which control commands are inputted, a controller 41, a driving unit 43, a memory 42, and a display unit 44 which displays an operational status of the refrigerator in addition to the components shown in FIGS. 1 to 3.

The input unit 40 includes a number of buttons such as a start button to start the control of the temperature of the supercooling compartment 20, which cools and stores the liquid beverage in a supercooled state and a select button to select a kind of liquid beverage such as water, juice and canned coffee.

The memory 42 stores freezing points Tm of various liquid beverages accommodated in the supercooling compartment 20 and a predetermined reference value ΔTc, which is larger than a temperature variation in the supercooling compartment 20, generated according to whether the blower fans 33 and 37 are operated or the opening/closing operation of the door and is smaller than a temperature variation due to rapid increase when supercooling fails to be achieved. Although different set values are stored in the memory 42 according to types of stored liquid beverages in this embodiment, the memory 42 is not necessarily required when the freezing point Tm and the reference value ΔTc are designed as a reference value, which is generally applicable to all liquid beverages through an experiment or the like.

The controller 41 controls the entire operation of the refrigerator. The controller 41 compares the temperature of the beverage or the like, which is sensed by the temperature sensor 22, with data stored in the memory 42 to determine whether a target object accommodated in the supercooling compartment 20 is normally in a supercooled state.

Specifically, the controller determines whether a temperature Ti of the liquid beverage at a current time point t, which is sensed by the temperature sensor 22 in cooling the liquid beverage, is lower than the freezing point Tm of the corresponding beverage. If the temperature Ti is lower than the freezing point of the corresponding beverage, the controller calculates an absolute value of a difference between the temperature Ti at a current time point t and a temperature Ti−1 of the liquid beverage at a time point earlier than the current time point t by a specified time Δt. Then, the controller compares the absolute value with the predetermined reference value ΔTc stored in the memory 42 to determine whether the supercooling fails to be achieved.

The driving unit 43 controls the on/off operation of the blower fans 33 and 37 according to a control signal of the controller 41 to adjust the temperature of the liquid beverage at a supercooling set temperature. The display unit 44 displays an operational status of the refrigerator or the like. The display unit 44 displays whether supercooling is normally in progress or supercooling fails to be achieved according to a control signal of the controller 41.

Hereinafter, an operation process and an effect of an operation control method of the refrigerator having the above configuration will be described with reference to FIGS. 5, 6A and 6B.

Figure 5:
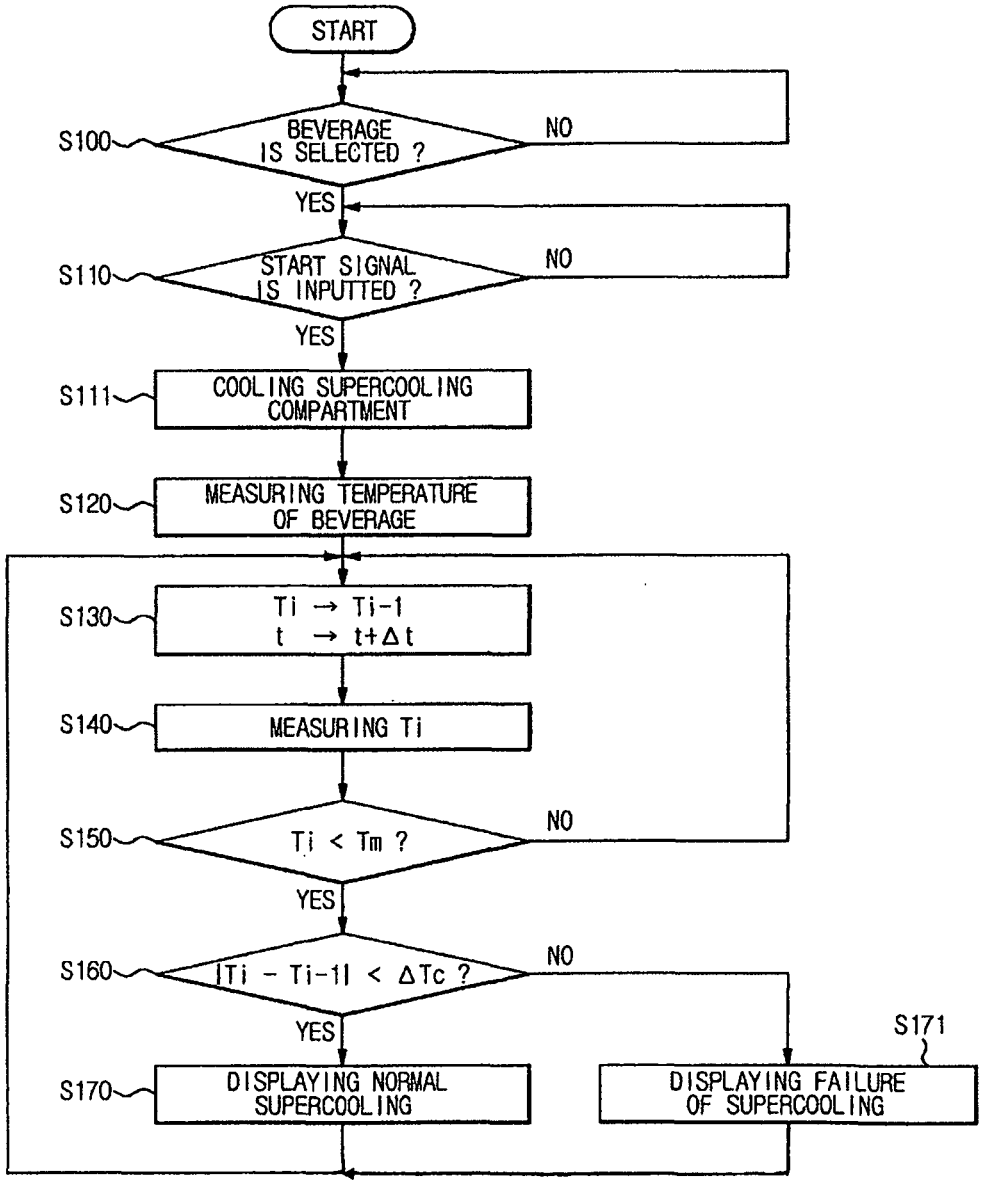
FIG. 5 illustrates an operational flowchart showing a control method of the refrigerator according to the first embodiment of the present invention.

FIG. 5 illustrates an operational flowchart showing a control method of the refrigerator according to the first embodiment of the present invention. The user locates the bottom surface of the liquid beverage (e.g., water) to be supercooled on the temperature sensor 22 disposed on the lower surface of the tray 21 of the supercooling compartment 20 and, then, pushes the select button of the input unit 40 to input a type of liquid beverage accommodated in the supercooling compartment 20 (S100). Accordingly, the controller 41 reads the freezing point Tm of the corresponding liquid beverage stored in the memory 42. Although the user selects the beverage in the control flow of this embodiment, the beverage may be automatically identified using a barcode and/or RFID. Further, when there is no input by the user, or when automatic reading is not performed, a value of a reference beverage may be applied.

Further, although the freezing point is differently set according to the beverage in this embodiment, in a case where the freezing point or the predetermined reference value ΔTc may be used as a fixed value, a beverage selection process may be omitted.

If the beverage is selected, then the controller 41 determines whether a cooling start signal is inputted through the start button disposed on the input unit 40 (S110). If the signal is inputted, the supercooling compartment is cooled to a specific target temperature by driving the blower fans 33 and 37 and the like (S111). In this case, the target temperature may be a supercooling temperature changed appropriately according to the liquid beverage or a fixed value.

Then, the temperature Ti of the liquid beverage is sensed (S120). The sensed temperature Ti is set as Ti−1 and stored in the memory 42, and the specified time Δt passes by (S130). Then, the temperature Ti of the liquid beverage is measured again to be stored in the memory 42 (S140). In this case, the specified time Δt may be appropriately designed using a sharp inclination in a temperature increase generated in cancellation of the supercooling state and the predetermined reference value ΔTc which allows determination of whether supercooling fails to be achieved.

It is then determined whether the sensed temperature Ti is lower than the freezing point Tm of the stored liquid beverage (S150). If the sensed temperature is lower than the freezing point of the stored liquid beverage, an absolute temperature difference between the temperature Ti and the temperature Ti−1 is compared with the predetermined reference value ΔTc stored in the memory 42 (a predetermined value which is larger than a temperature variation in the supercooling compartment 20 caused by the operation of the blower fans or the opening/closing operation of the door and is smaller than a temperature variation due to rapid increase due to loss of the supercooling state) (S160). If the temperature difference between Ti and Ti−1 is smaller than ΔTc, the display unit displays that supercooling is normally in progress (S170).

Meanwhile, if the sensed temperature Ti is equal to or higher than the freezing point Tm of the stored liquid beverage, the process returns to the operation S130, wherein Ti is set as Ti−1 to be stored in the memory 42 and after the specified time Δt passes, the measurement of the temperature Ti of the liquid beverage is repeated.

Further, if the temperature difference between Ti and Ti−1 is equal to or larger than ΔTc stored in the memory 42, failure of supercooling of the liquid beverage is displayed on the display unit (S171). If it is determined that supercooling of the liquid beverage fails to be achieved, cooling of the supercooling compartment is stopped to prevent unnecessary energy waste. Further, after natural thawing, the above-described control process may be repeated.

In this case, ΔTc means a predetermined value larger than a temperature variation due to adjustment of the temperature of the supercooling compartment 20 or opening/closing of the supercooling compartment 20 and smaller than a temperature variation rapidly increased in freezing of the liquid beverage. ΔTc may be selected within a range of 1° C.~10° C., but it is not limited thereto.

Further, although it is determined whether supercooling fails to be achieved using a difference between temperatures measured at specified time intervals in this embodiment, the following configuration is possible. That is, the temperature of the liquid beverage in the supercooling compartment is measured on a real time basis, and the temperature is continuously measured for the above-mentioned specified time Δt. Then, a temperature variation of a temperature-increased portion is integrated, and if the integrated value is equal to or larger than the predetermined reference value ΔTc, it is determined that supercooling fails to be achieved. This determination method allows a more accurate determination than determination at specified time intervals when it is determined whether supercooling fails to be achieved.

Figure 6A:
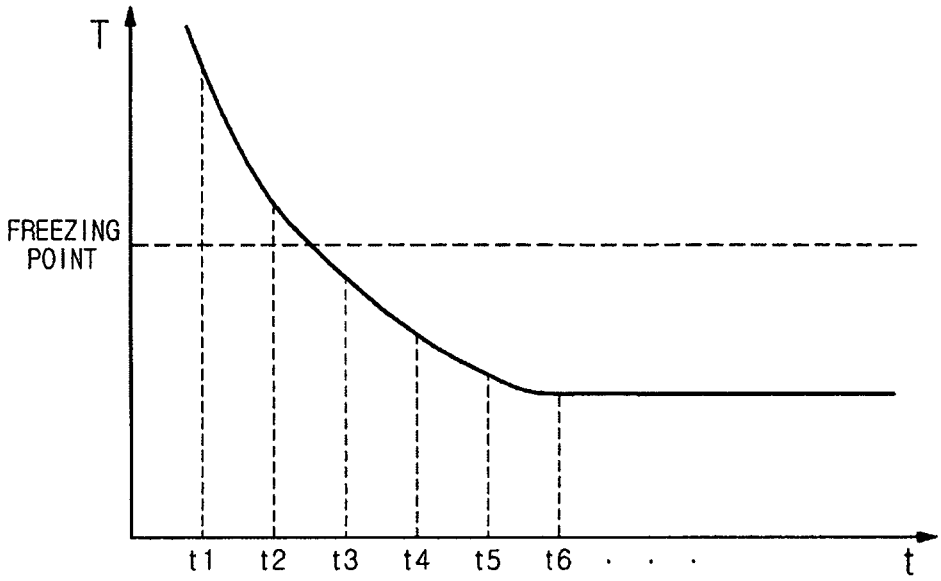
FIG. 6A is a temperature graph showing a temperature variation of a liquid beverage when supercooling is successfully in progress, according to the embodiment of the present invention.

FIG. 6A is a temperature graph showing a temperature variation of the liquid beverage when supercooling is successful. FIG. 6B is a temperature graph showing a temperature variation of the liquid beverage when supercooling fails to be achieved.

In FIG. 6A, since the temperatures measured at time points t1 and t2 are higher than the freezing point, an unnecessary calculation operation is not performed. Since the temperature measured at the next time point t3 is lower than the freezing point, a difference between the temperature measured at the current time point and the temperature obtained at the previous time point is calculated and the difference value is compared with the predetermined reference value ΔTc. As seen from the graph, since a temperature difference at a specified time interval is smaller than the predetermined reference value ΔTc at all time points t3~t6 . . . below the freezing point, the controller 41 determines that supercooling is normally in progress and displays this fact on the display unit 44.

Figure 6B:
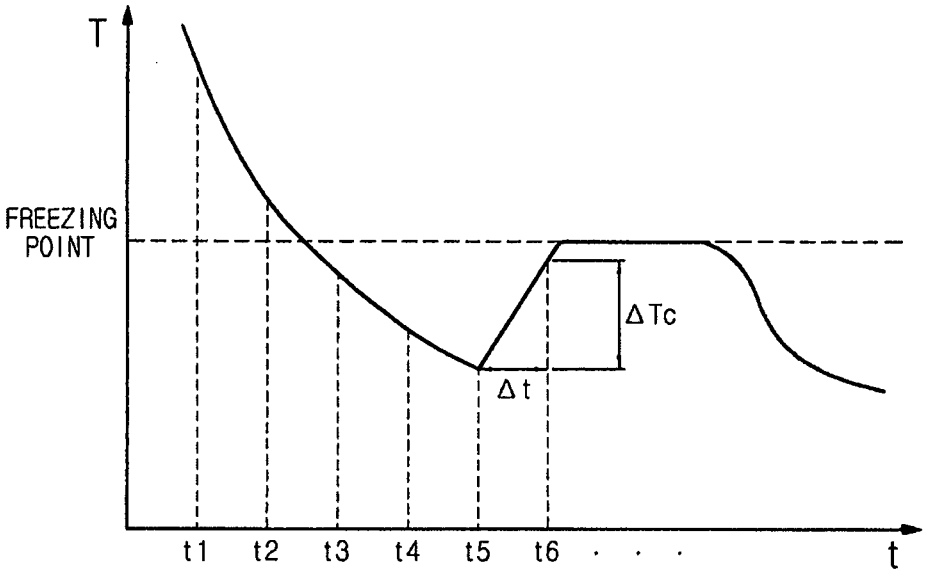
FIG. 6B is a temperature graph showing a temperature variation of the liquid beverage when supercooling fails to be achieved according to the embodiment of the present invention.

Meanwhile, in FIG. 6B, although the process is performed in the same way until a time point t5, a difference between the temperature at a time t6 and the temperature measured at a time earlier than the t6 by a specified time exceeds the predetermined reference value ΔTc. Accordingly, the controller 41 determines that a supercooling is not achieved and displays this fact on the display unit 44 so that the user may take action.

As described above, the control method of the refrigerator according to the first embodiment of the present invention provides an algorithm in which the predetermined reference value ΔTc and an interval of the specified time Δt are determined based on a rapid temperature increase change (inclination or the like) in failure of supercooling of the liquid beverage, a temperature difference value is calculated at each specified time interval, and it is determined whether supercooling fails to be achieved based thereon. Accordingly, it is possible to distinguish increases in temperature due to other causes (e.g., opening of the supercooling compartment, failure of a power supply or the like) from temperature increases due to failure of supercooling.

Further, since it is determined whether supercooling fails to be achieved below the freezing point of the liquid beverage, it is possible to prevent unnecessary calculation load above the freezing point, which is not required to determine whether supercooling fails to be achieved.

Hereinafter, a control block diagram and a control method of a refrigerator according to a second embodiment of the present invention will be described.

The control block diagram of the refrigerator according to the second embodiment has basically the same components as those of the first embodiment shown in FIG. 4, and further includes additional functions in a memory 52, a controller 51, a driving unit 53 and a display unit 54, wherein the components are indicated by different reference numerals to be distinguished from those of the first embodiment.

The memory 52 stores freezing points Tm of various liquid beverages accommodated in the supercooling compartment 20 and a predetermined reference value ΔTc which is larger than a temperature variation in the supercooling compartment 20 generated according to whether the blower fans 33 and 37 are operated and is smaller than a temperature variation which rapidly increases when the supercooling state is canceled. The memory 52 further stores an optimal supercooling set temperature Tset according to the liquid beverage.

The controller 51 is a microcomputer which controls the entire operation of the refrigerator. The controller determines whether a temperature Ti of the liquid beverage at a current time point t, which is sensed by the temperature sensor 22 in cooling of the liquid beverage, is lower than the freezing point of the corresponding beverage. If the sensed temperature is lower than the freezing point of the liquid beverage, the controller compares a difference between the temperature Ti at a current time point t and a temperature Ti−1 of the liquid beverage at a time point earlier than the current time point by a specified time Δt with a predetermined value stored in the memory to determine whether supercooling of the liquid beverage is normally in progress or fails to be achieved. If it is determined that supercooling is normally in progress, the temperature at a current time point sensed by the temperature sensor 22 is compared with the supercooling set temperature Tset to determine whether the stored liquid beverage is successfully supercooled. That is, it is also determined whether the liquid beverage has a target supercooling temperature in addition to whether supercooling is normally in progress. Then, it is provided to the user to inform the user whether the user can use the liquid beverage.

The driving unit 53 controls the on/off operation of the blower fans 33 and 37 according to a control signal of the controller 51 to set a target cooling temperature of the supercooling compartment at the supercooling set temperature Tset of each liquid beverage.

The display unit 54 displays an operational status of the refrigerator or the like. The display unit 54 displays whether supercooling is normally in progress or supercooling of the liquid beverage is achieved or fails to be achieved according to a control signal of the controller 51.

Figure 7:
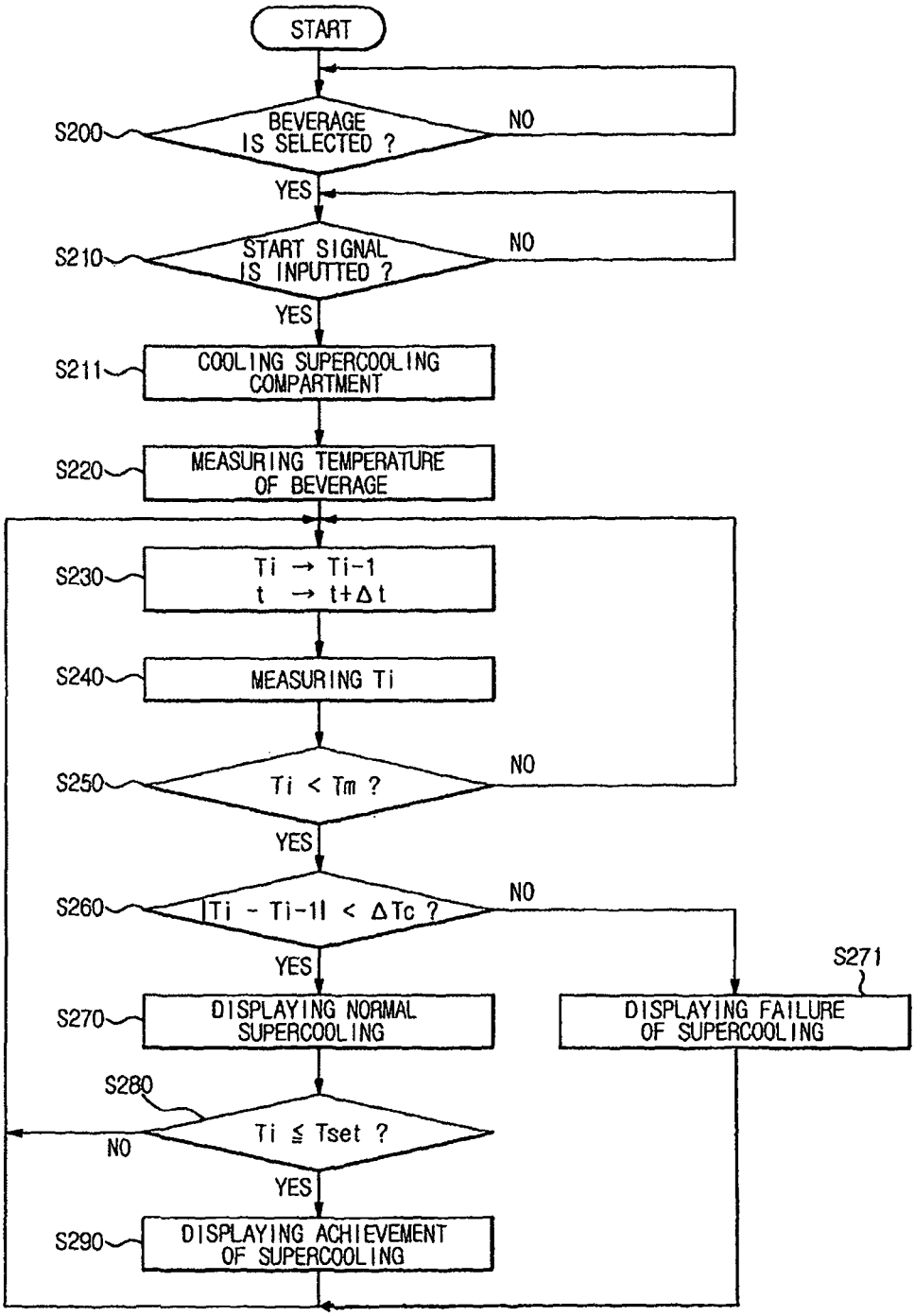
FIG. 7 illustrates an operational flowchart showing a control method of the refrigerator according to the second embodiment of the present invention.

Hereinafter, an operation process and an effect of a control method of the refrigerator according to the second embodiment of the present invention will be described with reference to FIG. 7.

The user locates the bottom surface of the liquid beverage (e.g., water, canned coffee, canned fermented rice drink, juice and bottled coffee) to be supercooled on the temperature sensor 22 disposed on the supercooling compartment 20 and, then, the controller 51 determines whether a beverage selection signal is inputted through the input unit 40 (S200). If the beverage selection signal is inputted, the controller 51 reads the freezing point Tm and the optimal supercooling set temperature Tset of the corresponding liquid beverage stored in the memory 52.

Then, the controller 51 determines whether a cooling start signal is inputted through the start button disposed on the input unit 40 (S210). If the start signal is inputted, the supercooling compartment is cooled by driving the blower fans 33 and 37 according to the optimal supercooling set temperature Tset of the corresponding liquid beverage (S211). Further, the temperature Ti of the liquid beverage is sensed (S220), and the sensed temperature Ti is set as Ti−1 and a specified time Δt passes (S230). Then, the temperature Ti of the liquid beverage is measured again (S240).

Next, it is determined whether the sensed temperature Ti is lower than the freezing point Tm of the stored liquid beverage (S250). If the sensed temperature is lower than the freezing point of the stored liquid beverage, a temperature difference between the temperature Ti and the temperature Ti−1 is compared with the predetermined reference value ΔTc stored in the memory 52 (a predetermined value which is larger than a temperature variation in the supercooling compartment caused by the operation of the blower fans and is smaller than a temperature variation rapidly increased in cancellation of the supercooling state) (S260). If the temperature difference between Ti and Ti−1 is smaller than ΔTc, a normally supercooled state is displayed in the display unit (S270).

Further, the controller 51 determines whether the temperature Ti of the liquid beverage is equal to or lower than the optimal supercooling set temperature Tset (S280). If the temperature Ti is equal to or lower than Tset, it is determined that supercooling of the current liquid beverage is successfully achieved, and this fact is displayed on the display unit 54 (S290).

Meanwhile, if the sensed temperature Ti is higher than the freezing point Tm of the stored liquid beverage, the process returns to the operation S230, wherein Ti is set as Ti−1 to be stored in the memory 52 and after the specified time Δt passes, the measurement of the temperature Ti of the liquid beverage is repeated.

Further, if the temperature difference between Ti and Ti−1 is equal to or larger than ΔTc stored in the memory 52, failure of supercooling of the liquid beverage is displayed on the display unit 54 (S271).

As described above, in the control method of the refrigerator according to the second embodiment of the present invention, the user can perceive whether supercooling of the liquid beverage is normally in progress or supercooling fails to be achieved or is achieved through the display unit 54.

Although the user selects and inputs a type of stored liquid beverage through the input unit, a barcode or RFID may be attached to the liquid beverage container without using the input unit, and a type of liquid beverage may be analyzed from the barcode or RFID attached to the corresponding beverage, thereby automatically inputting a type of stored liquid beverage.

Further, although an optimal supercooling temperature value is stored in the memory 52 according to a type of liquid beverage, and the value is read by the controller 51 and is used in the operation S211 or the operation S280, a fixed value, which is generally applicable to all liquid beverages, may be used in the same way as in the first embodiment. In this case, it may be possible to eliminate the memory 52.

Further, although an SBS refrigerator is used as an example, various refrigerators such as one-door refrigerator, TMF and BMF may also be used.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A control method of a refrigerator to determine a supercooled state of a target object in a cooling compartment, the method comprising:

sensing a temperature of the target object at each interval of a specified time Δt;

calculating a difference between two of the sensed temperatures;

comparing the difference between the two sensed temperatures with a predetermined reference value ΔTc to determine the supercooled state of the target object; and determining that supercooling is normally in progress if the difference between the two temperatures is smaller than the predetermined reference value.

2. The method according to claim 1, further comprising determining whether supercooling of the target object is achieved comprising determining whether the temperature of the target object is equal to or lower than a target supercooling temperature if it is determined that supercooling is normally in progress.

3. The method according to claim 1, further comprising determining that supercooling fails to be achieved if the difference between the two temperatures is equal to or larger than the predetermined reference value.

4. The method according to claim 3, further comprising stopping cooling of the target object if it is determined that supercooling fails to be achieved.

5. The method according to claim 1, wherein the reference value is larger than a temperature variation in the cooling compartment generated according to whether cool air is supplied to the cooling compartment or an opening/closing operation of the cooling compartment and is smaller than a temperature variation due to a rapid temperature increase when supercooling fails to be achieved.

6. The method according to claim 1, further comprising varying the reference value according to a beverage type of the target object.

7. The method according to claim 6, further comprising manually inputting a type of the target object by a user, or automatically inputting and identifying the type by a barcode or RFID.

8. The method according to claim 1, further comprising designating the specified time using the predetermined reference value and a temperature inclination due to a temperature increase when the supercooling fails to be achieved.

9. The method according to claim 1, further comprising displaying determination results of the supercooled state.

10. The method according to claim 1, wherein the calculating a difference between two sensed temperatures is performed when the sensed temperatures are lower than a freezing point of the target object.

11. A refrigerator which determines a supercooled state of a target object, comprising:

a cooling compartment, the target object being in the cooling compartment;

a temperature sensor which senses a temperature of the target object in the cooling compartment; and a controller which calculates a difference between two temperatures of the sensed temperatures at specified time intervals and compares the difference between the two temperatures with a predetermined reference value $\Delta Tc$ to determine the supercooled state of the target object;

wherein the controller determines that supercooling is normally in progress if the difference between the two temperatures is smaller than the predetermined reference value.

12. The refrigerator according to claim 11, further comprising:

a memory which stores reference values according to a type of the target object, wherein the controller varies the predetermined reference value $\Delta Tc$ according to a type of the target object.

13. The refrigerator according to claim 12, further comprising an input unit, wherein the type of the object is input to the input unit by a user.

14. The refrigerator according to claim 12, further comprising a reader to automatically read a type of the target object.

15. The refrigerator according to claim 11, further comprising a display unit which displays determination results of the supercooled state.

* * * * *